US005303838A

United States Patent [19]

Luch et al.

[11] Patent Number: 5,303,838

[45] Date of Patent: Apr. 19, 1994

[54] FRANGIBLE FITMENT FOR CONTAINER

[75] Inventors: Daniel Luch, Los Gatos; Brian M. Adams; Rawson Chenault, both of Newark, all of Calif.

[73] Assignee: Portola Packaging, Inc., San Jose, Calif.

[21] Appl. No.: 954,472

[22] Filed: Sep. 30, 1992

[51] Int. Cl.[5] ..... B65D 17/34; B65D 17/40

[52] U.S. Cl. ..... 220/270; 220/266; 220/276; 220/359; 229/125.15; 222/541

[58] Field of Search ..... 220/265, 266, 270, 276, 220/277, 359; 229/125.15, 125.17, 125.19, 125.32; 222/541

[56] References Cited

U.S. PATENT DOCUMENTS

| | | | |
|---|---|---|---|
| 3,458,080 | 7/1969 | Laurizio | 220/270 X |
| 3,990,603 | 11/1976 | Brochman | 220/260 |
| 4,391,385 | 7/1983 | Rausing | 220/307 |
| 4,393,979 | 7/1983 | Ball et al. | 220/270 |
| 4,408,697 | 10/1983 | Yoshikawa et al. | 220/279 |
| 4,513,876 | 4/1985 | Buchner | 220/270 |
| 4,669,640 | 6/1987 | Ando et al. | 220/266X |
| 4,770,325 | 9/1988 | Gordon et al. | 229/125.17 X |
| 4,801,037 | 1/1989 | Hayashida et al. | 220/259 |
| 4,887,765 | 12/1989 | Rausing | 229/123.2 |
| 5,069,372 | 12/1991 | Kawajiri | 220/270 X |

*Primary Examiner*—Gary E. Elkins
*Assistant Examiner*—Vanessa Caretto
*Attorney, Agent, or Firm*—Julian Caplan

[57] ABSTRACT

A container (e.g., an 8 oz. milk container) formed of paperboard, or the like, is formed with an aperture. A plastic disk is attached to the paperboard over the aperture by thermoplastic welding or other means. The disk has a frangible area which is opened to dispense contents. Typically the frangible area is penetrated by the end of a drinking straw. For aseptic packaging, the paperboard may be lined with a barrier, such as foil. Alternatively foil may be attached to the disk and welded to the paperboard surrounding the aperture or welded to a foil or polyethylene liner for the paperboard.

10 Claims, 4 Drawing Sheets

FRANGIBLE FITMENT FOR CONTAINER

BACKGROUND OF THE INVENTION

1. Field of the Invention

This invention relates to new and improved frangible disk fitment for a container. More particularly, the invention relates to a disk welded or otherwise attached over an aperture in a container such as a single service paperboard container or a plastic bag. The plastic disk is formed with a thin, frangible portion overlying the aperture in the container. In one embodiment, a straw or other implement is used to puncture a frangible portion and obtain access to the interior of the container to dispense contents. In another embodiment, a center portion of the disk is torn away to open the container.

2. Description of the Related Art

At the present time, liquids are merchandised in single-serve packets or pouches formed of paperboard or plastic film. An aperture is formed in the packet, exposing a thinner area of foil or film. The user punctures the thinner area with the end of a straw or other implement and thus obtains access to the contents of the container. In other cases, single use containers such as paperboard cartons and flexible bags are used as refills for heavier plastic bottles of household chemicals such as laundry detergents in an effort towards source reduction of packaging materials. These refill containers can be inconvenient to open. The present invention is an improvement on such structures.

SUMMARY OF INVENTION

In one embodiment, a frangible plastic disk is attached over an aperture in a container prior to shipment of the container. For example, paperboard cartons are shipped flat and erected at the rime they are filled. An advantage of one embodiment of the invention is that the plastic disk may be attached to the paperboard, by thermoplastic welding or other means at high speed, before the cardboard is erected. A frangible portion is formed on the disk. The consumer punctures the frangible portion of the disk, as with the end of a straw, to open the container. Accordingly the invention is suitable for single-service cartons, such as school milk cartons, or single-portion juice packets since it reduces the likelihood of spillage and further facilitates children opening the carton. The invention may also be applied to plastic (flexible) pouches.

The disk may be applied on the outside or the inside of the container, and the frangible portion may be fabricated in various ways.

The present invention is adapted to aseptic packaging. Thus the container may be lined with foil and the interior of the container, as well as the contents, sterilized.

In an alternate construction, the disk is attached on the underside of the container to the liner therefor. A foil disk, somewhat larger than the plastic disk, underlies the plastic disk; and the edges of the plastic disk are welded or otherwise aseptically secured to the liner of the container.

In another embodiment, the fitment is formed with a central removable portion frangibly connected to an outer attachment portion. A tear tab is connected to the removable portion. The consumer opens the package by grasping the tab and tearing away the central removable portion.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
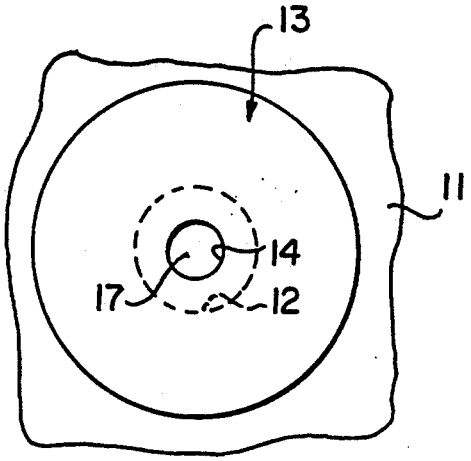
FIG. 1 is a fragmentary, plan view of a disk applied to the exterior of a container.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

A conventional plastic coated paperboard container 11 such as is used for single-portions (e.g. 8 oz.) of milk, is formed with an aperture 12. It will be understood that a wide variety of other containers (e.g., flexible pouches) may be used with the invention. Overlying the aperture 12 is a plastic disk 13. An upper relief 14 is formed in the upper surface of disk 13 and a lower relief 16 on the undersurface thereof leaving a frangible portion or area 17 in the center of the disk 13 overlying the aperture 12. The disk 13 may be attached to the container 11 by thermoplastic welding as indicated by reference numeral 18.

The consumer uses a blunt instrument, such as the end of a straw, to penetrate the frangible area 17 and gain access to the contents of the container. The frangible area 17 is sufficiently thin so that children may open the container but is stronger than the foil liners conventionally used in cartons of the prior art. Hence the disc 13 protects the container from being unintentionally punctured, yet makes it easy for even a child to dispense the contents.

Figure 2:
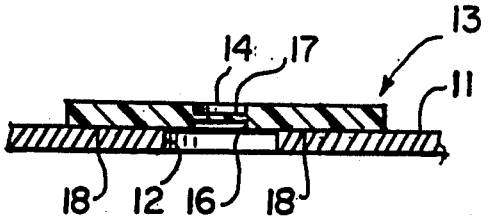
FIG. 2 is a sectional view through the structure of FIG. 1.
Figure 3:
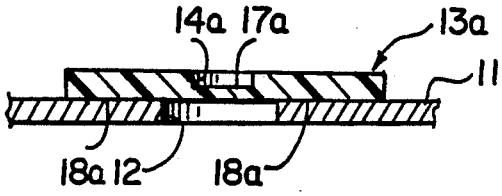
FIGS. 3 and 4 are views similar to FIG. 2 of modifications.

FIG. 3 shows an alternate construction wherein the upper relief 14*a* extends deeper into the plastic disk 13*a*, and there is no lower relief corresponding to the relief 16 of FIG. 2. It will be understood that other means may be used to form a frangible area 17 or 17*a* in the disk.

Figure 4:
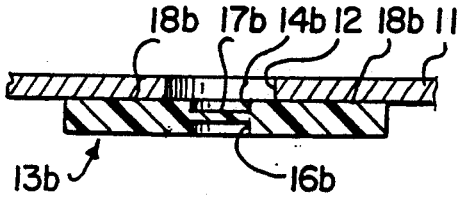

It will be noted that in FIGS. 2 and 3 the disk 13 or 13*a* are applied to the exterior. In FIG. 4 the disk 13*b* is applied to the underside of container 11.

Figure 5:
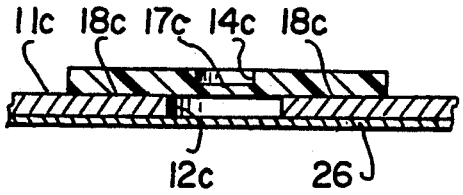
FIG. 5 is a sectional view showing the disk applied to a lined container.

The structure of FIG. 5 resembles that of FIG. 3 except that a foil barrier or liner 26 initially covers the hole 12*c*. The user uses the straw or other instrument penetrate both frangible section 17*c* and the foil barrier 26. Disc 13*c* protects against unintentional puncture of liner 26.

Figure 6:
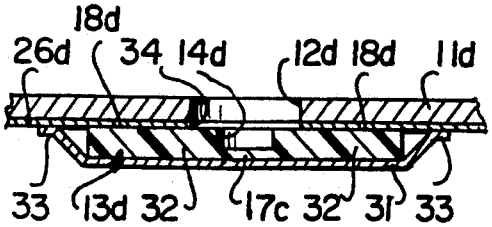
FIG. 6 is a view similar to FIG. 5 showing a separate aseptic foil disk underlying the plastic disk and welded to the liner for the container.

FIG. 6 illustrates an aseptic installation. The foil liner 26*d* is formed with an opening 34 coinciding with the aperture 12*d* in the container 11*d*. In the modification of FIG. 6, the disk 13*d* is applied on the underside of container 11*d*. As an aseptic feature of the construction, a foil disk 31 is welded as at reference numeral 32 to the underside of disk 13*d*. The edges of disk 31 extend beyond the margin of disk 13*d*, and the outer edges are welded by means of welds 33 to the liner 26*d* of the container 11*d*. Aseptic packaging may be employed with such a construction.

Figure 7:
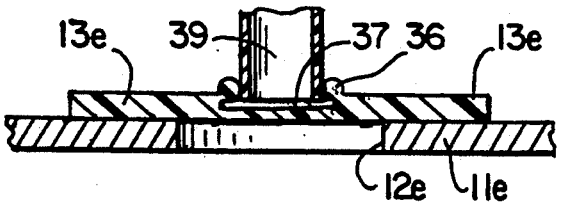
FIG. 7 is a sectional view of a modification of the embodiment of FIGS. 1–6.
Figure 8:
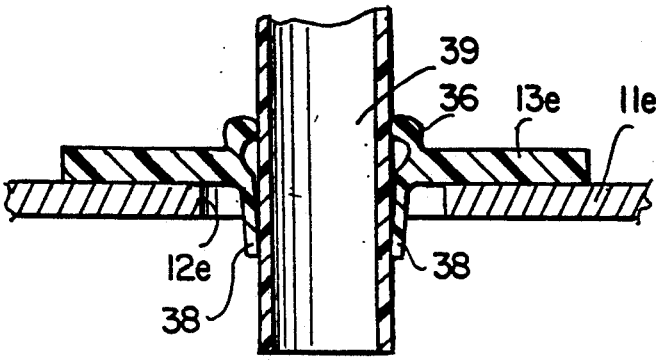
FIG. 8 shows insertion of a dispensing probe in the modification of FIG. 7.

In FIG. 7 a further modification is shown. Here the frangible section is surrounded by an upward extending rim 36 of generally circular cross-section. A depression 37 is formed in disk 13*c* below rim 36. A dispensing device or probe 39 of cylindrical cross-section greater than the circle defined by the rim is inserted into the depression. Thus, the dispensing tube 39 initially seals to the rim 36, which functions as an O-ring type seal, and then punctures the depression 37. In this case the container generally is collapsible to allow smooth dispensing of the liquid contents of the container or the dispensing tube 39 is designed with multiple channels to allow displacement fluid to enter the container as product is withdrawn when the tube 39 is forcibly depressed, depression 37 deforms and portions 38 thereof project into the container. (See FIG. 8).

Figure 10:
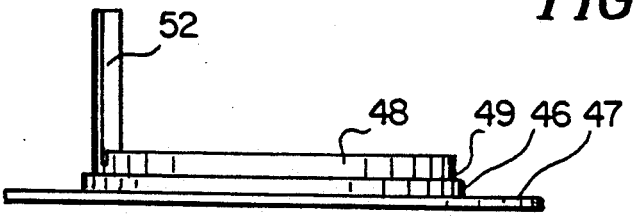
FIG. 10 is a side view of embodiment of FIG. 9.
Figure 9:
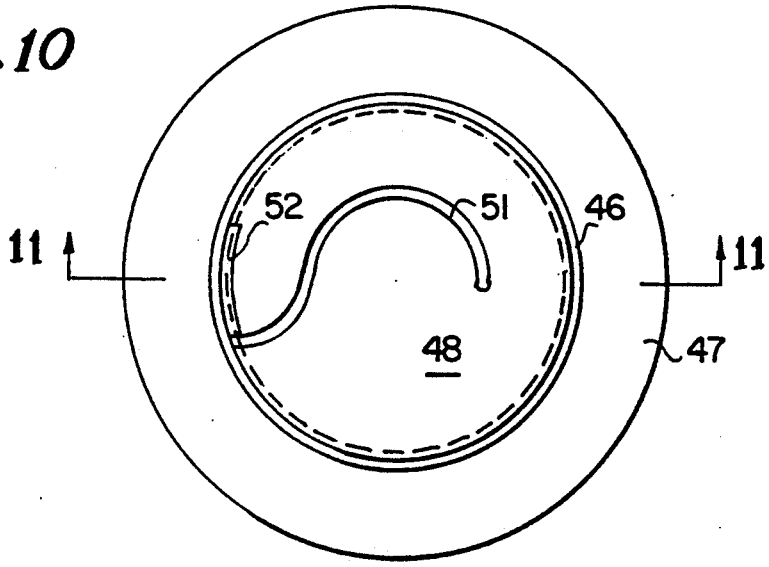
FIG. 9 is a plan view of a different modification.
Figure 11:
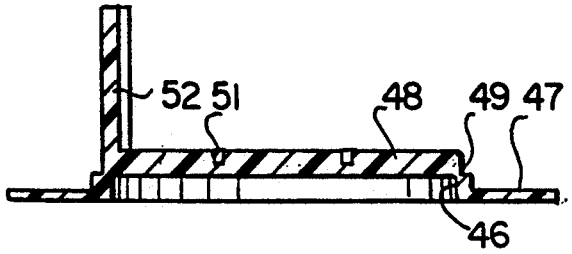
FIG. 11 is a sectional view taken along 11—11 of FIG. 9.

Turning now to the modifications shown in FIGS. 9–11, a fitment having a short cylindrical vertical collar 46 is provided at its lower end with a horizontal flange 47. Closing off the upper end of collar 46 is a disk 48, there being a notch 49 at the juncture of the outer edge of disk 48 and the upper end of collar 46 to facilitate tearing off disk 48, as hereinafter appears. Formed in the upper surface of disk 48 is a curvilinear groove 51 and adjacent one end of groove 51 at the outer edge of disk 48 is an upstanding tear tab 52. Flange 47 is attached to container 11*f* and the preferred form of attachment shown in FIG. 12 is for tile flange 47 to underlie the container 11*f* with the collar 46 projecting up through the opening 12*f* in the container.

Figure 12:
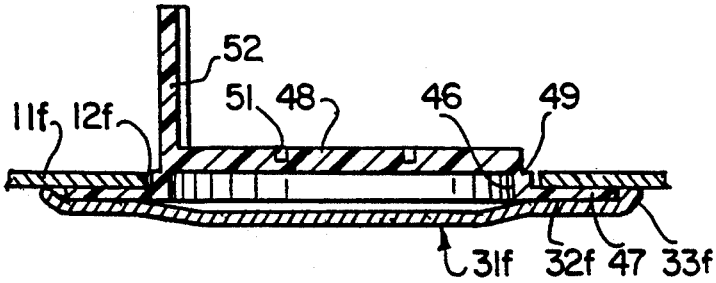
FIG. 12 is a sectional view of the embodiment of FIGS. 9–10 shown attached to a container with aseptic features added.
Figure 13:
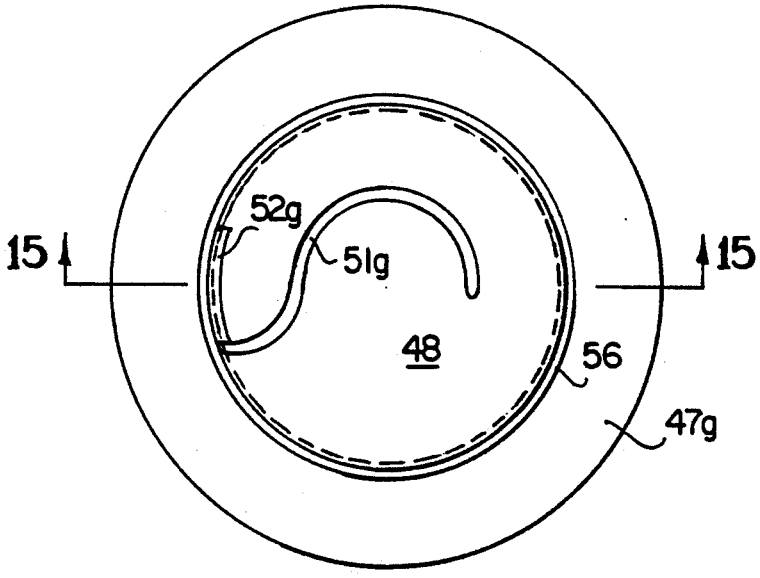
FIG. 13 is a plan view of another modification.
Figure 14:
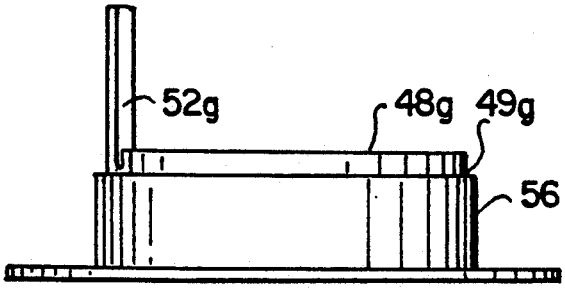
FIG. 14 is a side view of the FIG. 13 embodiment.
Figure 15:
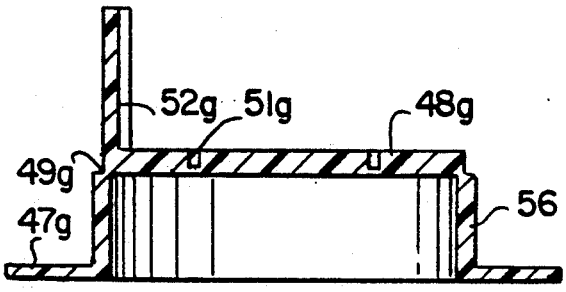
FIG. 15 is a sectional view taken along the line 15—15 of FIG. 13.
Figure 16:
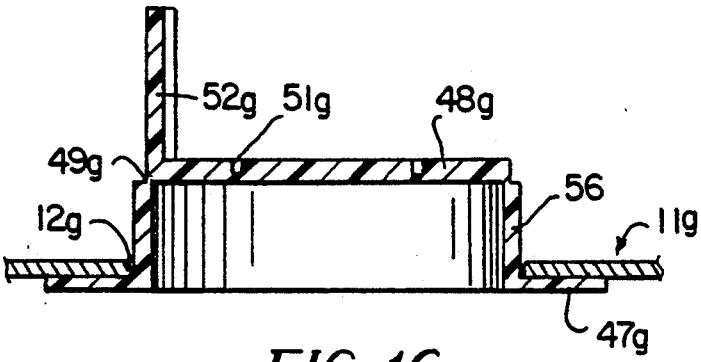
FIG. 16 is a sectional view of the modification of FIGS. 13–15 applied to a container.

In the modification shown in FIG. 12, a foil seal member 31*f* of a diameter greater than that of flange 47 underlies flange 47 and its outer edge is attached by weld 33*f* to the underside of container 11*f* and by weld 32*f* to the underside of flange 47. Accordingly in the modification of FIG. 12 the device may be used for aseptic packaging.

The user grips the pull tab 52 causing the disk 48 to sever along the groove 51 and causing the disk 48 to fracture at the notch 49 so that the disk may be removed, providing access to the contents. If the aseptic foil 31*f* is employed, the user then pierces the foil to obtain access to the contents.

The modification of FIGS. 13–16 is similar to that of the modification of FIGS. 9–11 except that the collar 56 is elongated to function as a pour spout, being a substitute for the relatively short collar 46 of the preceding modifications.

Figure 17:
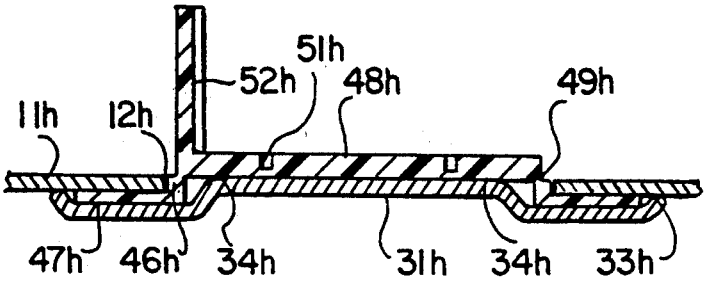
FIG. 17 is a modification of the aseptic seal of FIG. 12.

In the modification shown in FIG. 17, barrier foil 31*h* is attached to the underside of disk 48 through additional welds at positions 34*h* as shown. When disk 48*h* is removed, the foil is also torn away from the aperture, and there is no requirement for the consumer to subsequently puncture the foil.

Many of the features of the modification of FIGS. 3, 4, 5, 6, 7, 9, 13 and 17 resemble those of the preceding modifications and the same reference numerals, followed by subscripts a, b, c, d, e, f, g and h, respectively, represent corresponding parts.

The term "wall" as used in the appended claims includes not only the rigid or semi-rigid panel of a paperboard container, or the like, but also the flexible portion of a plastic pouch, or the like.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. In combination, a container having a wall said wall having an exterior and an interior and formed with an aperture, a plastic member comprising a plastic disk exteriorly of said wall, a collar depending from a periphery of said plastic disk extending through said aperture, a flange integral with said collar and extending radially outwardly from said collar and disposed on said interior of said wall, means securing said flange to said wall surrounding said aperture, a weakened annular connection between said collar and said periphery of said plastic disk, said disk being formed with a groove on a surface of said disk extending from said weakened annular connection generally radially inwardly of said plastic disk, said groove and said annular connection meeting at a point and a pull tab extending upwardly from said periphery of said plastic disk and adjacent said point, whereby when said pull tab is pulled upwardly away from said plastic disk, said plastic disk fractures at said point and along said groove and said annular connection.

2. The combination of claim 1 in which said groove comprises a curvilinear score line formed on said disk.

3. In combination, a container having a wall having an exterior and an interior and formed with an aperture, a plastic member comprising a plastic disk exteriorly of said wall, a collar depending from a periphery of said disk extending through said aperture, a flange integral with said collar and extending outwardly from said collar and disposed on said interior of said wall, means securing said flange to said wall surrounding said aperture, said plastic disk being attached to said collar by frangible means, and a tearable foil disk larger than said flange extending beyond the margins of said flange, said foil disk being located below said flange and engaging the underside of said plastic disk, said foil disk being welded to said plastic disk whereby when said foil disk is removed from said collar said foil disk is torn for access to said container, said foil disk being welded to said interior of said wall surrounding said flange to provide an aseptic seal for said container.

4. The combination of claim 3 in which said first means comprises means welding said disk to said wall.

5. The combination of claim 3 which further comprises a foil disk larger than said plastic disk and welded thereto, the margins of said foil disk extending beyond the margins of said plastic member, said margins of said foil disk being welded to said interior of said wall.

6. The combination of claim 3 in which said collar comprises a pour spout.

7. The combination of claim 3 which further comprises a foil disk larger than said flange, the margins of said foil disk extending beyond the margins of said flange, said margins of said foil disk being welded to said wall.

8. The combination of claim 7 wherein said foil disk is welded to said flange.

9. The combination of claim 7 wherein said foil disk is welded to said plastic disk.

10. The combination of said 3 in which said foil disk is welded to said flange.

* * * * *